US005831583A

United States Patent [19]

Lagerstedt et al.

[11] Patent Number: 5,831,583

[45] Date of Patent: Nov. 3, 1998

[54] WAVEGUIDE ANTENNA

[75] Inventors: Anders Lagerstedt; Rolf Lagerlöf, both of Gothenburg, Sweden

[73] Assignee: SAAB Ericson Space Aktiebolag, Gothenburg, Sweden

[21] Appl. No.: 647,939

[22] PCT Filed: Nov. 30, 1994

[86] PCT No.: PCT/SE94/01155

§ 371 Date: Aug. 1, 1996

§ 102(e) Date: Aug. 1, 1996

[87] PCT Pub. No.: WO95/15592

PCT Pub. Date: Jun. 8, 1995

[30] Foreign Application Priority Data

Nov. 30, 1993 [SE] Sweden ..... 9303986

[51] Int. Cl.[6] ..... H01Q 13/10

[52] U.S. Cl. ..... 343/771; 343/770; 343/772

[58] Field of Search ..... 343/771, 772, 343/770, 776, 768, 767; 333/21 R, 113; H01Q 13/10

[56] References Cited

U.S. PATENT DOCUMENTS

| | | | |
|---|---|---|---|
| 3,013,267 | 3/1961 | Rotman | 343/772 |
| 3,189,908 | 6/1965 | Provencher | 343/771 |
| 3,193,830 | 7/1965 | Provencher | 343/771 |
| 3,523,297 | 8/1970 | Fee | 343/771 |
| 3,653,054 | 3/1972 | Wen | 343/772 |
| 4,243,990 | 1/1981 | Nemit et al. | 343/771 |
| 4,839,663 | 6/1989 | Kurtz | 343/771 |
| 5,541,612 | 7/1996 | Josefsson | 343/771 |
| 5,638,079 | 6/1997 | Kastner et al. | 343/771 |

FOREIGN PATENT DOCUMENTS

| | | | |
|---|---|---|---|
| 911010536 | 1/1991 | European Pat. Off. . | |
| 0400126A1 | 8/1991 | European Pat. Off. . | |
| 9103555 | 11/1991 | Sweden . | |
| 1573604 | 8/1980 | United Kingdom | 343/771 |

*Primary Examiner*—Donald T. Hajec
*Assistant Examiner*—Tan Ho
*Attorney, Agent, or Firm*—Pepper Hamilton LLP

[57] ABSTRACT

A waveguide antenna includes a number of longitudinal waveguides with lateral and longitudinal slots arranged to emit electromagnetic fields with separate directions of polarization. The waveguide antenna includes a first waveguide having a first rectangular cross-section with lateral slots at substantially right angles with respect to the longitudinal axis of the first waveguide. The lateral slots are arranged in a first short side of the first waveguide. The waveguide antenna also includes a second waveguide having a second rectangular cross-section with longitudinal slots arranged in a second short side at substantially right angles with respect to the lateral slots, and a separating wall. The first and second waveguides are joined at respective first and second broad sides with the first and second short sides facing the same direction.

22 Claims, 4 Drawing Sheets

WAVEGUIDE ANTENNA

BACKGROUND OF THE INVENTION

The present invention relates to a waveguide antenna comprising a number of longitudinal waveguides with lateral and longitudinal slots, arranged to emit electromagnetic fields with different directions of polarization. Such antennae are used particularly in the satellite technique, but can also be of interest for flight-borne radar. There are for instance demands for a compact construction. Such a waveguide antenna is described in the Swedish published application with application No. 9103555-0 and publication No. 469,540, and shows upper and lower longitudinal waveguides, with a mutual broad side, with longitudinal as well as lateral slots in the upper broad side of the upper waveguide. A waveguide antenna is built of a number of such combined upper and lower waveguides, arranged beside each other, i.e. with mutual short sides. Such a waveguide antenna is compact, per se, but shows a limited possible deflection of the antenna lobe across the waveguide relative to the normal of the antenna.

The object of the present invention is to achieve a waveguide antenna of the kind mentioned in the introduction, which is compact in its construction and makes possible a great deflection of the antenna lobe relative to the normal of the antenna without secondary lobes (grid lobes) being formed.

SUMMARY OF THE INVENTION

According to the invention such a waveguide antenna is primarily characterized in that it comprises a first kind of waveguide having a rectangular cross-section with lateral slots, preferably at right angle to the longitudinal axis of the waveguide, arranged in its first short side, and also comprises a second kind of waveguide having a rectangular cross-section with longitudinal slots arranged in its first short side and with a separating wall arranged symmetrically, going out from its second short side, partly extending towards its first short side, the waveguides of the first and second kind, alternately, being joined at their broad sides with said first short sides facing the same direction forming the waveguide antenna. With this embodiment of a waveguide of the second kind in the form of a so-called ridge waveguide with single ridge the total cross-dimension of the two waveguides is reduced to about half a free space wavelength.

Within the scope of the present invention, different directions of polarization are conceivable, but orthogonal directions of polarization are of special interest, which can be obtained if the slots in the waveguide of the first kind are arranged at right angles to those in the waveguide of the second kind.

Different embodiments are conceivable. The first short sides of the waveguides can for instance lie in a mutual first plane. It is also conceivable that the first short sides of the waveguides lie in separate planes, preferably so that their second short sides lie substantially in a mutual second plane.

The slots can be formed in different ways. The lateral slots can for instance be oriented at right angles to the longitudinal axis of the waveguide, or form any other than right angle to it. The lateral slots can extend lying entirely within the plane of the short side, or cut down a little in the ajoining broad sides. This embodiment means that at a certain given $\lambda g/2$ the waveguide can be formed with a short side having a smaller extension, i.e. a more compact antenna is obtained. The lateral slots are suitably located at a distance of about $\lambda g/2$ from each other. The use of field-displacing protrusions such as metallic threads etc. constitutes a technique known per se, which is applicable within the scope of this invention too.

BRIEF DESCRIPTION OF THE DRAWINGS

The invention is described in the following, reference being made to the accompanying figures, which schematically shows examples of embodiments of a waveguide of the first and second kind. A waveguide antenna according to the invention is thus built up by a number of such waveguides arranged beside each other with mutual broad sides. So, it is shown by FIG. 1 in perspective, a first embodiment of a waveguide of the first kind combined with a waveguide of the second kind.

DESCRIPTION OF THE PREFERRED EMBODIMENTS

Figure 1:
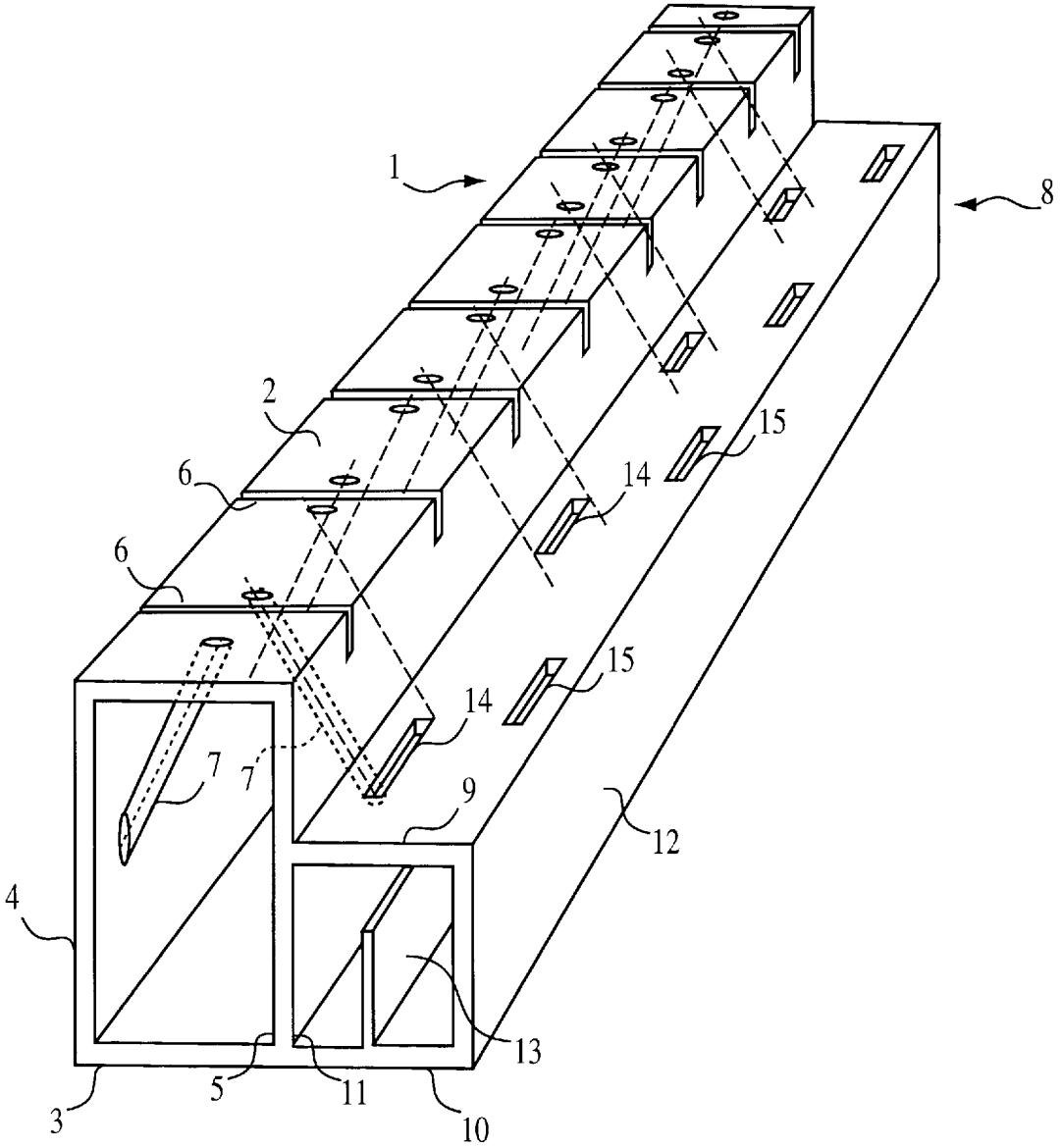

In FIG. 1, a waveguide of the first kind with rectangular cross-section is designated by 1. It shows a first short side 2, a second short side 3, a first broad side 4 and a second broad side 5. A number of lateral slots 6 are arranged in the first short side 2 at a distance of about $\lambda g/2$ from each other. The slots cut down a little in the broad sides 4 and 5. Field-displacing pairs of metal threads 7 are arranged at the lateral slots in such a way that when feeding an electromagnetic wave of TE(H) basic mode in the waveguide 1, an electromagnetic field with the direction of polarization perpendicular to the slots is emitted.

Figure 3:
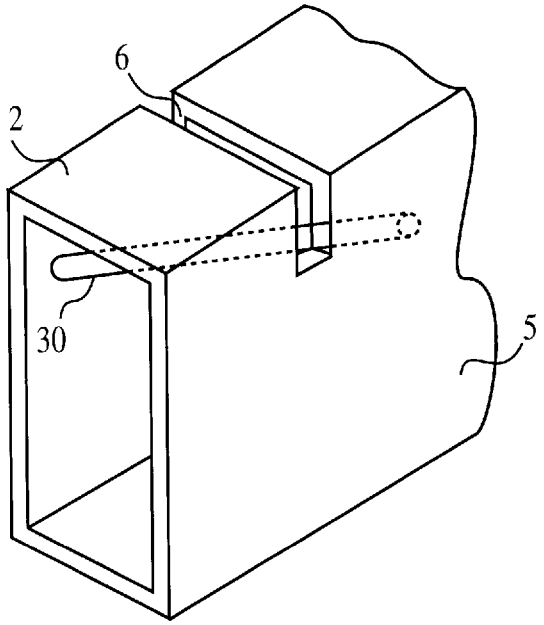
FIG. 3 in perspective shows part of a waveguide of the first kind in an additional embodiment.
Figure 3A:
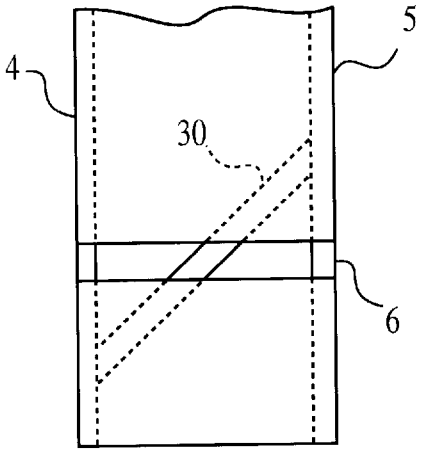
FIG. 3A shows a plan view of the object in FIG. 3.
Figure 3B:
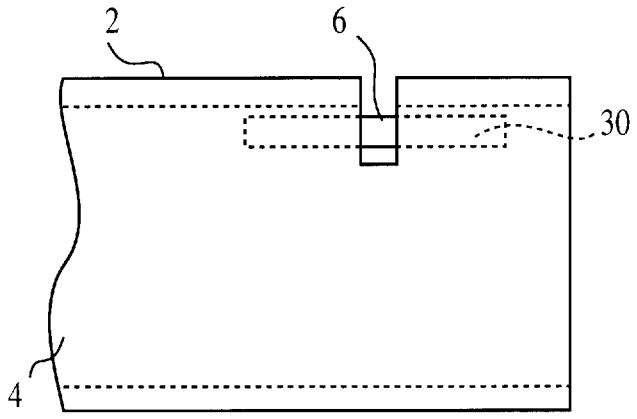
FIG. 3B shows a side view of the object in FIG. 3.
Figure 4:
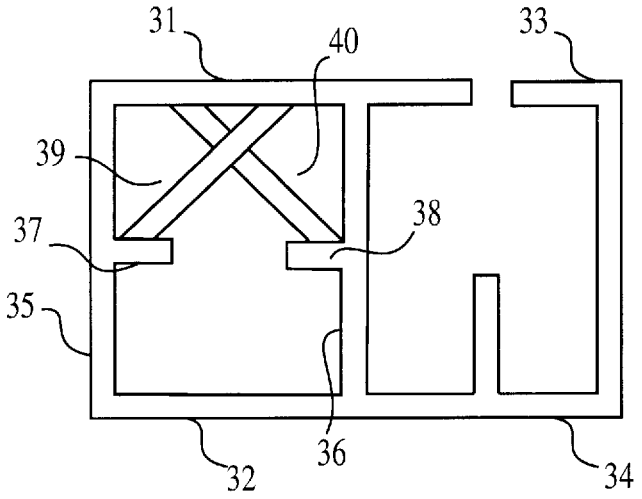
FIG. 4 a cross-section of an alternative embodiment of waveguide of the first and second kinds.

In FIG. 3, 3A and 3B an alternative embodiment of field displacing metal threads 30 is shown, which metal threads in this case extend with an exciting thread per slot between the broad sides 4 and 5 of the first waveguide.

A waveguide of the second kind with rectangular cross-section is designated in FIG. 1 by 8. Its first short side is designated by 9, its second short side by 10, its first broad side by 11, mutual with a portion of the second broad side 5 of the first waveguide 1. Its second broad side is designated by 12. A separating wall 13 is inserted symmetrically in the second waveguide, extending from the second short side 10 partly towards the first short side 9. Longitudinal slots 14 are arranged along a longitudinal line between the first broad side 11 and the plane of the separating wall 13, at a distance of about $\lambda g$ between the slots. Along a line between the plane of the separating wall 13 and the second broad side 12 there are slots 15 arranged, likewise at a mutual distance of about $\lambda g$, but displaced $\lambda g/2$ relative to the first-mentioned slots 14. When feeding an electromagnetic wave of the same kind as that just mentioned regarding the first waveguide, to this second waveguide, an electromagnetic field is emitted with a direction of polarization perpendicular to the slots, causing the antenna to emit an orthogonally polarized electromagnetic field.

Figure 2:
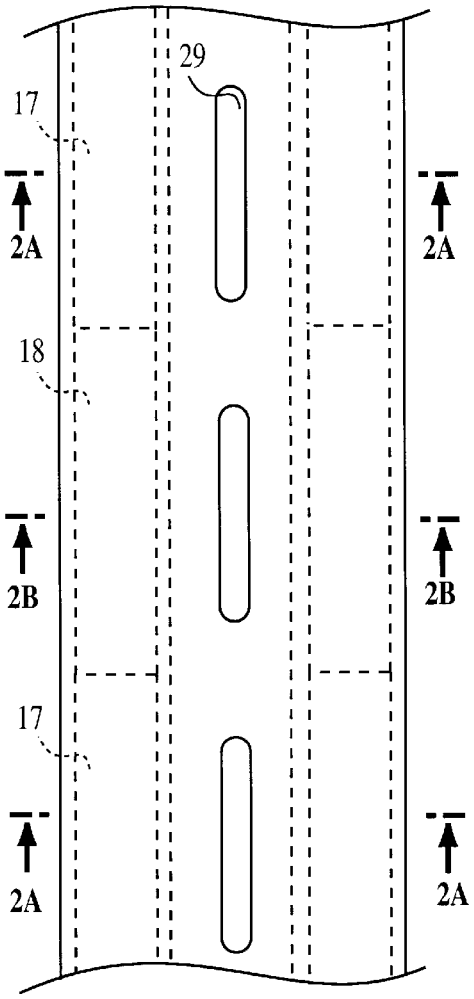
FIG. 2 a plan view of part of another embodiment of a waveguide of the second kind.
Figure 2A:
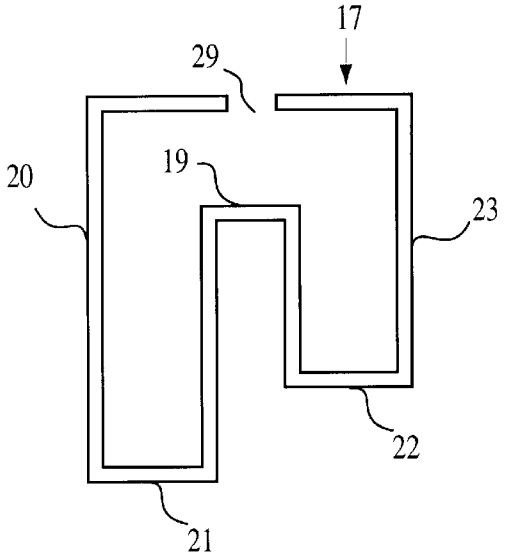
FIG. 2A a cross-section along the marking A—A in FIG. 2.
Figure 2B:
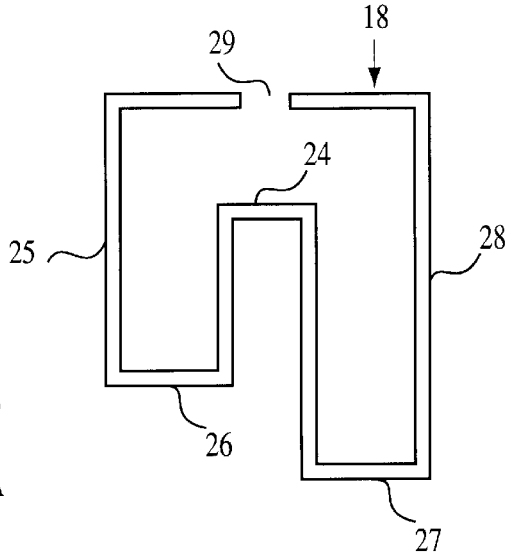
FIG. 2B a cross-section along the marking B—B in FIG. 2.

Within the scope of the invention, the waveguides can be formed in different ways. The slots can be oriented with other angles relative to the longitudinal axes of the waveguides than those shown in FIG. 1, but it is particularly advantageous to arrange them as shown, because thereby orthogonal polarization with great purity of polarization, i.e. low cross-polarization can be obtained. The waveguide of the second kind can in an alternative embodiment be formed as appears from the FIGS. 2, 2A and 2B. Longitudinally, this waveguide is put together alternately by sections 17 and 18, each provided with a longitudinal, symmetrically located separating wall 19, 24 which in this case is wider than the separating wall in the embodiment shown in FIG. 1. In FIG. 2A a cross-section is shown of section A and in FIG. 2B a cross-section through section B. The first short sides of the sections are designated too by 17 and 18, respectively. The second short sides of the waveguide is located within either section partly at a relatively great distance from the first short side, with the designations 21, 27 and partly at a relatively short distance, with the designations 22, 26. The side 20 of the waveguide defines in this connection its one broad side, even if the side 25 is shorter, but is part of the same plane. The same is true for its other side 28 with the side 23 in the same plane. The slots are designated by 29.

In an alternative embodiment, the first 31, 33 and second 32, 34 short sides of the waveguides lie separate in a mutual plane, the waveguide of the first kind being provided with separating walls 37, 38 going out from the broad sides extending towards each other, leaving a space between them. In this case, pairs of field displacing metal threads 39, 40 excite the radiation through the lateral slots.

We claim:

1. A waveguide antenna having a number of longitudinal waveguides with lateral and longitudinal slots arranged to emit electromagnetic fields with separate directions of polarization, comprising:

a first waveguide (1) having a first rectangular cross-section with lateral slots (6) at substantially right angles with respect to the longitudinal axis of the first waveguide, the lateral slots arranged in a first short side (2) of the first waveguide, and a second waveguide (8) having a second rectangular cross-section with longitudinal slots (14, 15) arranged in a second short side (9) at substantially right angles with respect to the lateral slots, and with a separating wall (13) arranged substantially symmetrical and going out from a third short side (10) partly extending towards the second short side (9), wherein the first and second waveguides being joined at respective first and second broad sides (5, 11 or 4, 12) with said first and second short sides (2, 9) facing the same direction, forming the waveguide antenna.

2. A waveguide antenna according to claim 1, characterized in that the first and second waveguides with the lateral and longitudinal slots are arranged to emit the electromagnetic fields with substantially orthogonal polarizations.

3. A waveguide antenna according to claim 1, characterized in that the lateral and longitudinal slots of the first and second waveguides lie substantially in a mutual first plane.

4. A waveguide antenna according to claim 1, wherein the first waveguide includes a fourth short side, and the waveguide antenna characterized in that the first and second short sides (2, 9) of the first and second waveguides lie in separate planes, and the third and fourth short sides (3, 10) lie substantially in a mutual second plane.

5. A waveguide antenna according to claim 1, characterized in that the lateral slots lie at a distance of about $\lambda g/2$ from each other, where $\lambda g$ is a guide wavelength representing a wave periodicity in a longitudinal direction.

6. A waveguide antenna according to claim 1, wherein the first waveguide includes a fourth short side, and the waveguide antenna characterized in that the first and second short sides (2, 9 or 31, 33) and the third and fourth (32, 34) short sides of the first and second waveguides each lies in mutual planes, the first waveguide being provided with separating walls (37, 38) going out from broad sides and extending towards each other leaving a space therebetween.

7. A waveguide antenna according to claim 6, characterized in that the first and second waveguides with the lateral and longitudinal slots are arranged to emit the electromagnetic fields with substantially orthogonal polarizations.

8. A waveguide antenna according to claim 6, characterized in that the lateral and longitudinal slots of the first and second waveguides lie substantially in a mutual first plane.

9. A waveguide antenna according to claim 6, wherein the first waveguide includes a fourth short side, and the waveguide antenna characterized in that the first and second short sides of the first and second waveguides lie in separate planes, and the third and fourth short sides lie substantially in a mutual second plane.

10. A waveguide antenna according to claim 6, characterized in that the lateral slots lie at a distance of about $\lambda g/2$ from each other, where $\lambda g$ is a guide wavelength representing a wave periodicity in a longitudinal direction.

11. A waveguide antenna according to claim 6, characterized in that the first and second short sides of the first and second waveguides lie substantially in a mutual first plane.

12. A waveguide antenna having waveguides with at least one of lateral and longitudinal slots arranged to emit electromagnetic fields with directions of polarization, comprising:

a first waveguide having a first rectangular cross-section with at least one lateral slot at a substantially right angle with respect to a longitudinal axis of the first waveguide, and separating walls emerging from opposing sides of the first waveguide and extending towards each other leaving a space therebetween; and a second waveguide responsively connected to said first waveguide, and having a second rectangular cross-section with at least one longitudinal slot arranged at a substantially right angle with respect to the at least one lateral slot.

13. A waveguide antenna according to claim 12, characterized in that the first and second waveguides with the lateral and longitudinal slots are arranged to emit the electromagnetic fields with substantially orthogonal polarizations.

14. A waveguide antenna according to claim 12, characterized in that the lateral and longitudinal slots of the first and second waveguides lie substantially in a mutual first plane.

15. A waveguide antenna according to claim 12, wherein the first waveguide includes a fourth short side, and the waveguide antenna characterized in that the first and second short sides of the first and second waveguides lie in separate planes, and the third and fourth short sides lie substantially in a mutual second plane.

16. A waveguide antenna according to claim 12, characterized in that the lateral slots lie at a distance of about $\lambda g/2$ from each other, where $\lambda g$ is a guide wavelength representing a wave periodicity in a longitudinal direction.

17. A waveguide antenna according to claim 12, characterized in that the first and second short sides of the first and second waveguides lie substantially in a mutual first plane.

18. A waveguide antenna having waveguides with at least one of lateral and longitudinal slots arranged to emit electromagnetic fields with directions of polarization, comprising:

a first waveguide having a first rectangular cross-section with at least one lateral slot at a substantially right angle with respect to a longitudinal axis of the first waveguide:

a second waveguide responsively connected to said first waveguide, and having a second rectangular cross-section with at least one longitudinal slot arranged at substantially right angles with respect to the at least one lateral slot: and at least one field displacing device responsively connected to the at least one lateral slot, wherein the lateral and longitudinal slots of the first and second waveguides lie substantially in a mutual first plane.

19. A waveguide antenna according to claim 18, characterized in that the first and second waveguides with the lateral and longitudinal slots are arranged to emit the electromagnetic fields with substantially orthogonal polarizations.

20. A waveguide antenna according to claim 18, wherein the first waveguide includes a fourth short side, and the waveguide antenna characterized in that the first and second short sides of the first and second waveguides lie in separate planes, and the third and fourth short sides lie substantially in a mutual second plane.

21. A waveguide antenna according to claim 18, characterized in that the lateral slots lie at a distance of about $\lambda g/2$ from each other, where $\lambda g$ is a guide wavelength representing a wave periodicity in a longitudinal direction.

22. A waveguide antenna according to claim 18, characterized in that the first and second short sides of the first and second waveguides lie substantially in a mutual first plane.

* * * * *